US010428592B2

(12) United States Patent
Gupta et al.

(10) Patent No.: US 10,428,592 B2
(45) Date of Patent: Oct. 1, 2019

(54) RIG LAYOUT SYSTEM

(71) Applicant: Nabors Drilling Technologies USA, Inc., Houston, TX (US)

(72) Inventors: Ashish Gupta, Houston, TX (US); Ryan Hause, Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 19 days.

(21) Appl. No.: 15/872,220

(22) Filed: Jan. 16, 2018

(65) Prior Publication Data

US 2018/0202237 A1 Jul. 19, 2018

Related U.S. Application Data

(60) Provisional application No. 62/446,720, filed on Jan. 16, 2017.

(51) Int. Cl.
*E21B 15/00* (2006.01)
*E21B 33/06* (2006.01)
(Continued)

(52) U.S. Cl.
CPC ..... *E21B 15/00* (2013.01); *E21B 15/003* (2013.01); *E21B 33/06* (2013.01); *E21B 19/155* (2013.01); *E21B 21/01* (2013.01)

(58) Field of Classification Search
CPC ..... E21B 15/00; E21B 15/003
See application file for complete search history.

(56) References Cited

U.S. PATENT DOCUMENTS 1,733,484 A 10/1929 Davis
2,332,479 A 10/1943 Woolslayer et al.
(Continued)

FOREIGN PATENT DOCUMENTS

CA 2755483 A1 11/2010
CA 2753417 A1 2/2011
(Continued)

OTHER PUBLICATIONS

Nabors 990 Proyecto Llanos.WMV; https://www.youtube.com/watch?v=6BgfgWumRIU, Nabors RIG 990 Chichimene, Colombia; Youtube.com; Aug. 10, 2011 (231 pages).
(Continued)

*Primary Examiner* — D. Andrews
*Assistant Examiner* — Tara E Schimpf
(74) *Attorney, Agent, or Firm* — Adolph Locklar

(57) ABSTRACT

A system comprises a wellsite including a wellbore location and a BOP positioned at the wellbore location, a drilling rig in the wellsite and including a rig floor and at least one substructure, the substructure having a longitudinal axis, and a first access area defined as the area between a pair of lines extending parallel to the longitudinal axis of the substructure such that the BOP is between the lines, the first access area being free of equipment that is not in transit. The first access area may include a left access area on a first side of the rig, which area may be free of equipment that is not in transit. A method for drilling may include maintaining the left access area free of equipment during rig-up and may further include moving the rig within the wellsite while maintaining at least the left access area free of equipment.

15 Claims, 6 Drawing Sheets

(51) Int. Cl.
*E21B 19/15* (2006.01)
*E21B 21/01* (2006.01)

(56) References Cited

U.S. PATENT DOCUMENTS 2,345,253 A 3/1944 Funk
2,347,115 A 4/1944 Lewis
2,594,847 A 4/1952 Bates et al.
3,028,881 A 4/1962 Koomey et al.
3,255,836 A 6/1966 Hoppmann et al.
3,433,268 A 3/1969 Greer
3,483,933 A 12/1969 Dyer et al.
3,576,225 A 4/1971 Chambers
3,676,984 A 7/1972 Clark
3,716,149 A 2/1973 Scaggs
3,739,853 A 6/1973 Wales
3,802,137 A 4/1974 Armstrong
3,851,770 A 12/1974 Jenkins et al.
3,922,825 A 12/1975 Eddy et al.
3,937,334 A 2/1976 Bleyl et al.
3,942,593 A 3/1976 Reeve, Jr. et al.
3,991,887 A 11/1976 Trout
4,021,978 A 5/1977 Busse et al.
4,029,165 A 6/1977 Miller et al.
RE29,541 E 2/1978 Russell
4,117,941 A 10/1978 McCleskey et al.
4,221,088 A 9/1980 Patterson
4,235,566 A 11/1980 Beeman et al.
4,267,675 A 5/1981 Cochran
4,290,495 A 9/1981 Elliston
4,403,898 A 9/1983 Thompson
4,407,629 A 10/1983 Willis
4,421,179 A 12/1983 Boyadjieff
4,473,977 A 10/1984 Reed
4,474,254 A 10/1984 Etter et al.
4,478,015 A 10/1984 Lawrence et al.
4,478,291 A 10/1984 Futros
4,488,708 A 12/1984 Frye
4,493,382 A 1/1985 Collins et al.
4,587,778 A 5/1986 Woolslayer et al.
4,744,710 A 5/1988 Reed
4,757,592 A 7/1988 Reed
4,759,414 A 7/1988 Willis
4,823,870 A 4/1989 Sorokan
4,834,604 A 5/1989 Brittain et al.
4,850,439 A 7/1989 Lund
4,899,832 A 2/1990 Bierscheid, Jr.
4,979,578 A 12/1990 Landry
5,107,940 A 4/1992 Berry
5,248,005 A 9/1993 Mochizuki
5,305,833 A 4/1994 Collins
5,375,667 A 12/1994 Trevisani
5,492,436 A 2/1996 Suksumake
5,921,336 A 7/1999 Reed
6,161,358 A 12/2000 Mochizuki et al.
6,491,477 B2 12/2002 Bennett, Jr. et al.
6,581,525 B2 6/2003 Smith
6,634,436 B1 10/2003 Desai
6,779,614 B2 8/2004 Oser
6,848,515 B2 2/2005 Orr et al.
6,955,223 B2 10/2005 Orr et al.
6,962,030 B2 11/2005 Conn
6,976,540 B2 12/2005 Berry
7,228,919 B2 6/2007 Fehres et al.
7,255,180 B2 8/2007 Beato et al.
7,306,055 B2 12/2007 Barnes
7,308,953 B2 12/2007 Barnes
7,401,656 B2 7/2008 Wood et al.
7,404,697 B2 7/2008 Thompson
7,600,585 B2 10/2009 Patton et al.
7,628,229 B2 12/2009 Wood et al.
7,765,749 B2 8/2010 Palidis
7,819,207 B2 * 10/2010 Cowan ..... E21B 7/02 175/52
7,832,974 B2 11/2010 Fikowski et al.
7,878,254 B2 2/2011 Abdollahi et al.
7,931,076 B2 4/2011 Ditta et al.
7,967,540 B2 6/2011 Wright et al.
7,992,646 B2 8/2011 Wright et al.
8,051,930 B1 11/2011 Barnes et al.
8,181,698 B2 5/2012 Springett et al.
8,250,816 B2 8/2012 Donnally et al.
8,297,362 B1 10/2012 Strider et al.
8,316,588 B2 11/2012 Cicognani
8,468,753 B2 6/2013 Donnally et al.
8,474,216 B1 7/2013 Goerner
8,516,751 B2 8/2013 Konduc et al.
8,549,815 B2 10/2013 Donnally et al.
8,555,564 B2 10/2013 Wasterval
8,561,685 B2 10/2013 Rodgers
8,573,334 B2 11/2013 Smith et al.
8,661,743 B2 3/2014 Flusche
8,720,128 B2 5/2014 Vogt
8,813,436 B2 8/2014 Donnally et al.
8,863,449 B2 10/2014 Donnally et al.
8,985,238 B2 3/2015 Sorokan et al.
8,985,928 B2 3/2015 Flusche
8,997,435 B2 4/2015 Reddy et al.
9,016,004 B2 4/2015 Vogt
9,027,287 B2 5/2015 Trevithick et al.
9,091,125 B2 7/2015 Konduc et al.
9,091,126 B2 7/2015 Thiessen et al.
9,132,871 B2 9/2015 Crisp et al.
9,140,080 B2 9/2015 Flusche
9,151,412 B2 10/2015 Trevithick et al.
9,163,462 B2 10/2015 Donnally et al.
9,212,481 B2 12/2015 Stramandinoli
9,228,394 B2 1/2016 Wijning et al.
9,249,626 B2 2/2016 Flusche
9,260,929 B2 2/2016 Mark
9,267,328 B2 2/2016 Flusche
9,309,728 B2 4/2016 Reddy et al.
9,334,668 B2 5/2016 Wijning et al.
9,353,601 B2 5/2016 Hause
9,382,766 B2 7/2016 Flusche
9,399,890 B2 7/2016 Mark
9,441,423 B2 9/2016 Donnally et al.
9,366,053 B2 10/2016 Thiessen et al.
9,464,488 B2 10/2016 Thiessen
9,488,014 B2 11/2016 Sparkman et al.
9,562,407 B2 2/2017 Magnuson
9,631,443 B2 4/2017 Folk
9,650,840 B2 5/2017 Cheng et al.
9,677,298 B2 6/2017 Konduc et al.
9,708,861 B2 7/2017 Reddy et al.
9,739,098 B2 8/2017 Fox
9,790,751 B2 10/2017 Reddy et al.
9,810,027 B2 11/2017 Reddy et al.
9,845,813 B2 12/2017 Shimizu et al.
9,879,442 B2 1/2018 Magnuson et al.
9,926,719 B2 3/2018 Reddy et al.
2002/0001255 A1 1/2002 Flood et al.
2003/0172599 A1 * 9/2003 Frink ..... E21B 15/003 52/116
2008/0237170 A1 10/2008 Altman et al.
2009/0000218 A1 1/2009 Lee et al.
2009/0025980 A1 1/2009 Callander et al.
2009/0053013 A1 2/2009 Maltby
2009/0188677 A1 * 7/2009 Ditta ..... E21B 7/02 166/382
2009/0200856 A1 8/2009 Chehade et al.
2009/0272540 A1 11/2009 Rodgers
2010/0186960 A1 7/2010 Reitsma et al.
2011/0072737 A1 3/2011 Wasterval
2011/0174545 A1 7/2011 Hartke et al.
2012/0168179 A1 7/2012 Having et al.
2012/0304553 A1 12/2012 Konduc et al.
2013/0291452 A1 11/2013 Donnally et al.
2013/0305632 A1 11/2013 Rivera, Sr. et al.
2014/0014417 A1 1/2014 Smith et al.
2014/0054097 A1 2/2014 Bryant
2015/0041220 A1 2/2015 Wells, Sr.
2015/0315861 A1 11/2015 Zachariasen et al.
2016/0186495 A1 6/2016 Flusche

(56) References Cited

U.S. PATENT DOCUMENTS

| | | | |
|---|---|---|---|
| 2016/0215592 | A1 | 7/2016 | Helms et al. |
| 2016/0280524 | A1 | 9/2016 | Crisp et al. |
| 2016/0369570 | A1 | 12/2016 | Reddy et al. |
| 2017/0106925 | A1 | 4/2017 | Gupta et al. |
| 2017/0292334 | A1 | 10/2017 | Reddy et al. |
| 2017/0350153 | A1 | 12/2017 | Reddy et al. |
| 2018/0016851 | A1 | 1/2018 | Reddy et al. |
| 2018/0030788 | A1 | 2/2018 | Reddy et al. |
| 2018/0119496 | A1 | 5/2018 | Reddy et al. |
| 2018/0128056 | A1 | 5/2018 | Gupta et al. |

FOREIGN PATENT DOCUMENTS

| | | | |
|---|---|---|---|
| CN | 201778661 | U | 3/2011 |
| EP | 2751370 | B1 | 7/2014 |
| FR | 2556042 | A1 | 6/1985 |
| WO | 2016025521 | A2 | 2/2016 |
| WO | 2016048458 | A1 | 3/2016 |

OTHER PUBLICATIONS

Drilling Contractor; "Nabors modular Rig 702 in Papua New Guinea-bound for ExxonMobil"; Drilling Contractor, in Drilling Rigs & Automation, News, Jul. 6, 2011; 2 pages; www.drillingcontractor.org.

Drilling Contractor; "Nabors to base all future land rigs on Minimum Area AC rig concept"; Drilling Contractor, in News, Aug. 22, 2011; 2 pages; www.drillingcontractor.org.

Sebastion, Simone; "Big drill soon begins long commute to work"; Houston Chronicle, Sunday, Jul. 3, 2011; 3 pages; www.chron.com.

Gaddy, Dean E., "Critical path analysis improves rig-moving procedures", Oil & Gas Journal, Nov. 16, 1998 (5 pages).

International Search Report and Written Opinion issued in PCT/US18/13798, dated May 15, 2018 (10 pages).

* cited by examiner

RIG LAYOUT SYSTEM

TECHNICAL FIELD/FIELD OF THE DISCLOSURE

The present disclosure relates generally to drilling of wells, and specifically to wellsites.

BACKGROUND OF THE DISCLOSURE

When drilling a wellbore, a drilling rig is positioned at the site of the wellbore to be formed, defining a wellsite. The drilling rig may be used to drill the wellbore. Additional wellsite equipment may be utilized with the drilling rig. The additional wellsite equipment may include, for example and without limitation, one or more generators, fuel tanks, variable frequency drives (VFDs), mud pumps, suction tanks, intermediate tanks, sack houses, parts houses, charge pumps, service skids, water tanks, and mud process tanks. Traditionally, the additional wellsite equipment may be positioned about the drilling rig on multiple sides of the drilling rig.

SUMMARY

A system in accordance with the present disclosure may include a wellsite that includes a wellbore location and a blowout preventer (BOP) positioned at the wellbore location, a drilling rig positioned in the wellsite, the drilling rig including a rig floor and at least one substructure, the substructure having a longitudinal axis, the rig floor including a V-door side, the side of the drilling rig adjacent to the V-door side defining a V-door area, and a first access area defined as the area between a pair of lines extending parallel to the longitudinal axis of the substructure such that the BOP is between the lines, the first access area being free of equipment that is not in transit. The first access area may include a left access area on a first side of the rig and a right access area on an opposite side of the rig from the left access area, and the left access area may be free of equipment that is not in transit. The system may further include a second access area defined as the area between a pair of lines extending perpendicular to the longitudinal axis of the substructure. The second access area may include a far access area on one side of the rig and a near access area on an opposite side of the rig from the far access area, and a far left quadrant may be defined between the left access area and the far access area. The system may further include at least one piece of backyard equipment in the far left quadrant.

In some embodiments, all of the backyard equipment may be positioned in the far left quadrant. The backyard equipment may comprise one or more of a generator, a fuel tank, a variable frequency drive (VFD), a mud pump, a parts house, a suction tank, an intermediate tank, a sack house, a charge pump, a service skid, a water tank, a mud process tank, a cuttings bin, and a trip tank.

The drilling rig may further comprise a mast pivotably coupled to the drill floor and pivotable between raised and lowered positions such that the mast is in the left access area when in the lowered position or such that the mast is in the far access area when in the lowered position. The system may further include a pipe handling system in the right access area or in the near access area.

The system may further include a walking mud handling system in fluid communication with the rig and/or a festoon system supporting cables that are connected to equipment on the rig.

The drilling rig may comprise two substructures, and each substructure may be generally rectangular in footprint and spaced apart in a parallel fashion. The V-door side of the rig may be perpendicular or parallel to the longitudinal axes of the substructures, and, correspondingly, the system may further include a catwalk having a longitudinal axis that is perpendicular or parallel to the longitudinal axes of the substructures.

The present disclosure also includes a method for drilling multiple wells on a single wellsite, comprising the steps of a) providing a first wellbore location, b) positioning a blowout preventer (BOP) at the wellbore location, c) positioning a drilling rig at the wellbore location, the drilling rig including a rig floor and at least one substructure, the substructure having a longitudinal axis, the rig floor including a V-door side, the side of the drilling rig adjacent to the V-door side defining a V-door area, d) defining a first access area as the area between a pair of lines extending parallel to the longitudinal axis of the substructure such the BOP is between the lines, e) using the rig to drill at the first wellbore location, and f) maintaining the first access area free of equipment that is not in transit at least during drilling. The V-door area may be outside the first access area.

The method may further include accessing the BOP from a side of the rig adjacent to the V-door side and may also further include, before step e), the steps of: i) providing at least one piece of backyard equipment; and ii) simultaneously rigging-up the backyard equipment and the drilling rig. The method may further include maintaining the first access area free of equipment that is not in transit during step ii).

In some embodiments, the first access area may include a left access area on a first side of the rig and a right access area on an opposite side of the rig from the left access area, and the left access area may be free of equipment that is not in transit. The system may further include a second access area defined as the area between a pair of lines extending perpendicular to the longitudinal axis of the substructure, and the second access area may include a far access area on one side of the rig, a near access area on an opposite side of the rig from the far access area, and a far left quadrant is defined between the left access area and the far access area. The backyard equipment may be positioned in the far left quadrant.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
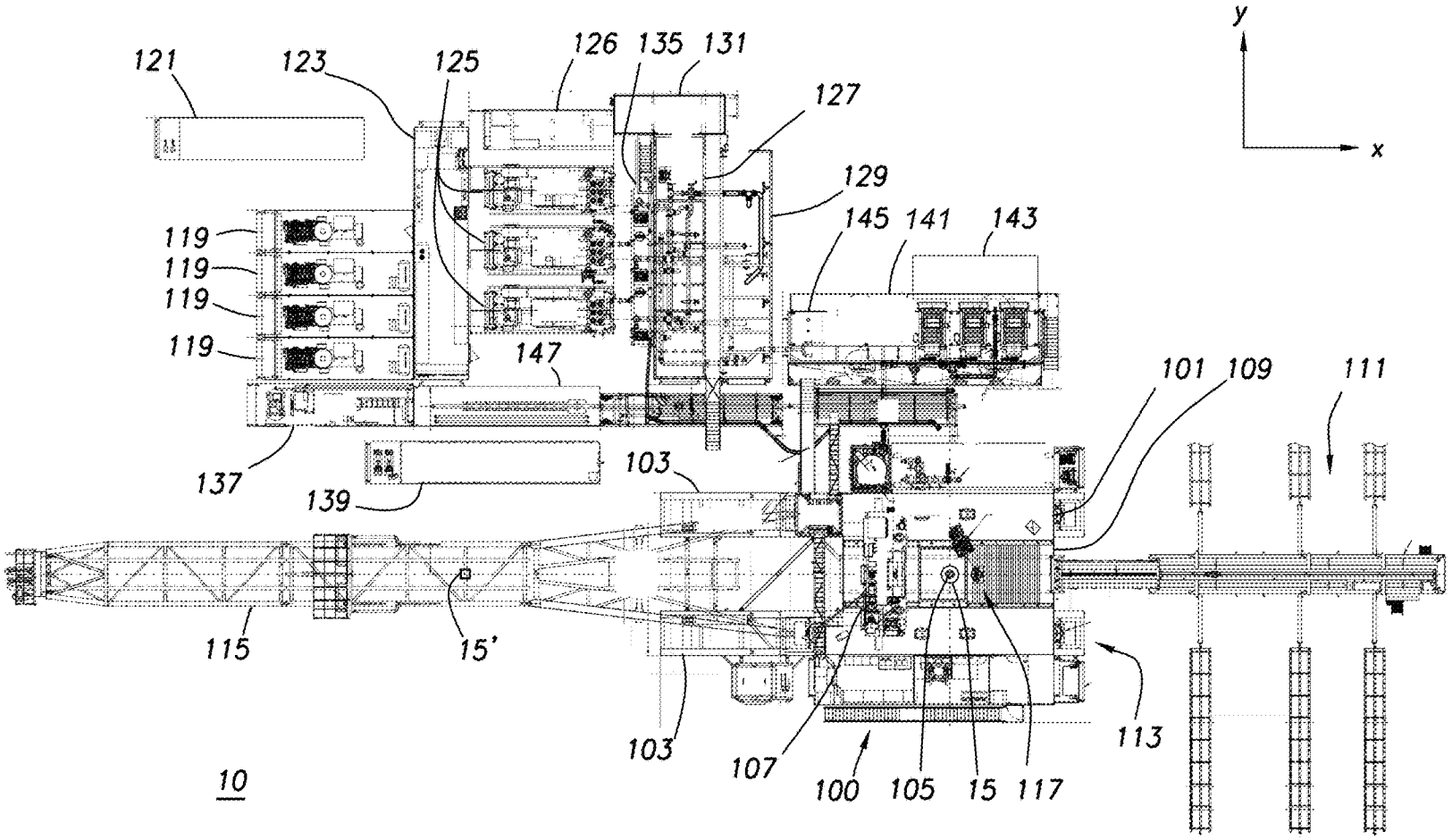
FIG. 1 depicts a top-view of a wellsite consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

As depicted in FIG. 1, a wellsite 10 comprises a plot of land that includes a drilling rig 100 and one or more specific locations at which it is desired to drill into the earth. Drilling rig 100 may be positioned above one such location, shown as wellhead 15. Drilling rig 100 may include rig floor 101 and one or more substructures 103. "Substructure" as used herein refers to a foundation structure of drilling rig 100 on which rig floor 101 and other drilling rig equipment may be supported. Substructures 103 may rest on the ground of wellsite 10. In some embodiments, two substructures 103 may be included with drilling rig 100. In such an embodiment, each substructure 103 may be generally rectangular in footprint with a longitudinal axis 203, and may extend at least the length of rig floor 101 in a parallel, spaced-apart fashion. Rig floor 101 may include a rotary table 105 positioned in line with a wellhead 15. In some embodiments, drilling rig 100 may include drawworks 107 and other drilling rig equipment.

Rig floor 101 may include a V-door side 109. The V-door itself (not shown) may be an opening or other structure of the rig through which drill pipe, casing, or other tubulars may be introduced to drilling rig 100. In some embodiments, a pipe handling system 111 may be positioned in wellsite 10 adjacent to drilling rig 100 on the V-door side of drilling rig 100. Pipe handling system 111 may be used to store and load tubulars such as drill pipe and casing horizontally before being loaded onto drilling rig 100 through the V-door. Pipe handling system 111 may include one or more of a catwalk, slide, pipe rack, or other such equipment. The area of wellsite 10 adjacent to V-door side 109 defines a V-door area 113.

In some embodiments, such as that depicted in FIG. 1, V-door side 109 and V-door area 113 together may define an axis that is parallel to the longitudinal axis 203 of at least one substructure 103. In other embodiments, discussed below, V-door side 109 and V-door area 113 may define an axis that is normal to the longitudinal axis 203.

In some embodiments, a mast may be pivotably coupled to rig floor 101. In some embodiments, the mast may pivot between a raised position and a lowered position. The lowered position is illustrated in phantom at 115 in FIG. 1. As illustrated, in some embodiments, the mast may pivot in a plane that is parallel to the longitudinal axes of substructures 103 and may pivot in a direction away from V-door area 113 of drilling rig 100. In other embodiments, discussed below, the mast may pivot in a plane that is perpendicular to the longitudinal axes of substructures 103.

In some embodiments, drilling rig 100 may include a mast, which may be a vertical structure above rig floor 101 that is used to support one or more hoists, traveling blocks, pipe elevators, top drives, pipe racks, or any other drilling equipment (not shown). The mast may include an open side through which one or more tubulars may be introduced and which defines a V-door side of the mast, located generally as indicated by 117 in FIG. 1. As shown, V-door side 117 of mast 115 may be oriented to face V-door area 113 of drilling rig 100.

Still referring to FIG. 1, one or more pieces of additional wellsite equipment may be positioned at wellsite 10 in proximity to drilling rig 100. Additional wellsite equipment may include, for example and without limitation, one or more generators 119, fuel tanks 121, variable frequency drives (VFDs) 123, mud pumps 125, parts houses 126, suction tanks 127, intermediate tanks 129, sack houses 131, charge pumps 135, service skids 137, water tanks 139, mud process tanks 141, cuttings bins 143, and trip tanks 145, as well as any connections between the additional wellsite equipment and between any piece of wellsite equipment and drilling rig 100, including festoon system 147. In the aggregate, all or a subset of these pieces of additional equipment may be referred to herein as the "backyard." Further, as used herein, "backyard" may refer to some or all of the equipment used for operations, including but not limited to power generation, control, mud storage and treatment, and mud pumps.

Figure 2:
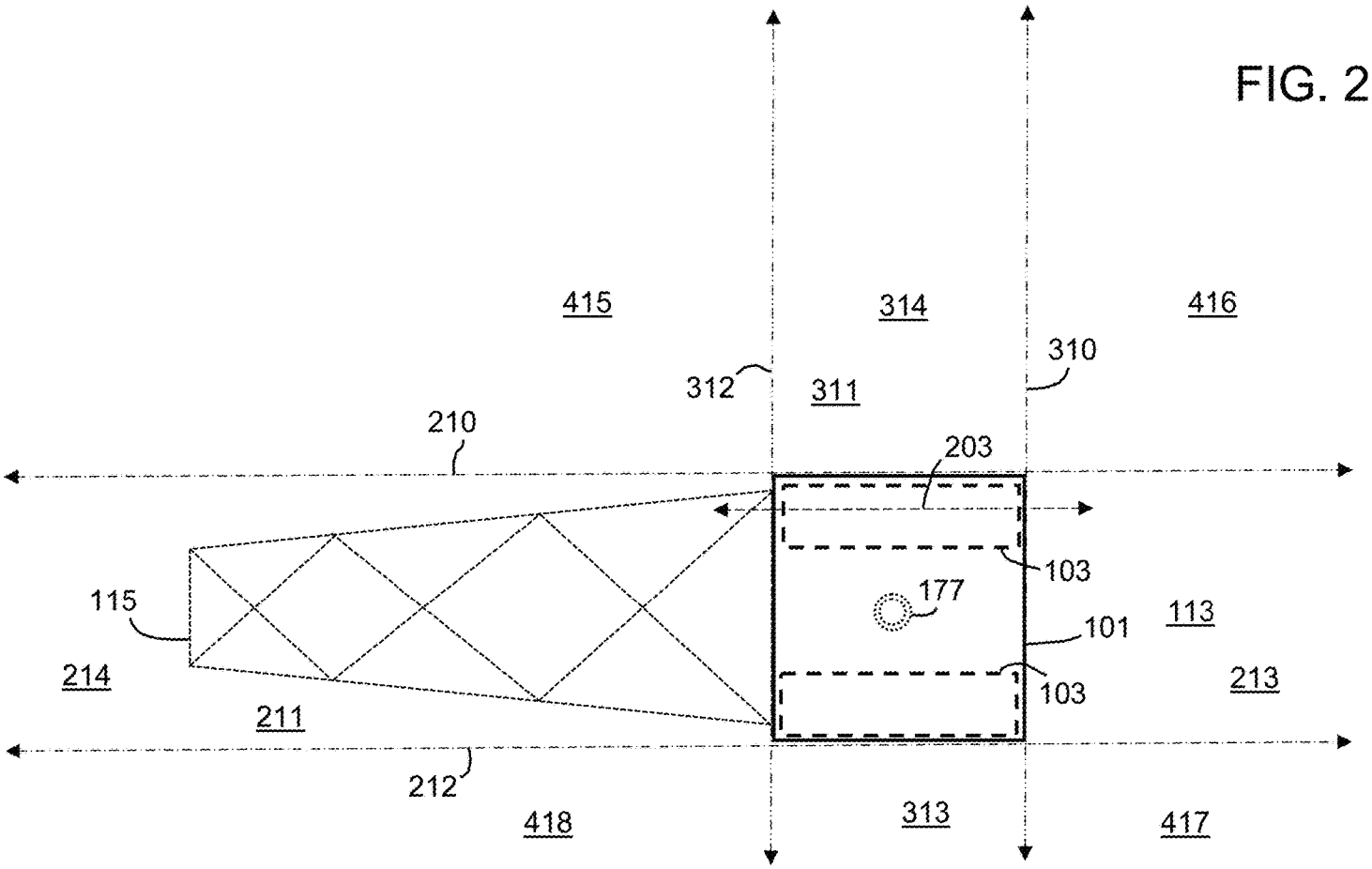
FIG. 2 is a schematic plan view of a wellsite in accordance with at least one embodiment of the present disclosure.

Referring now to FIG. 2, a schematic plan view of wellsite 10 includes rig floor 101, substructures 103 (shown in phantom), a mast in the "down" position 115, and a V-door area 113. Also shown in phantom because it is beneath the rig floor 101 is a blow-out preventer (BOP) stack 177.

A pair of phantom lines 210, 212 are each parallel to one side of rig floor 101 adjacent to one of the support structures, respectively. Lines 210, 212 define an access area 211 therebetween. By definition, rig floor 101 lies in first access area 211. The portion of access area 211 on the right (as drawn) of the rig floor is referred to herein as right access area 213 and the portion of access area 211 on the left (as drawn) of the rig floor is referred to herein as the left access area 214. In the embodiment shown, the V-door area 113, which is defined above as being adjacent to the V-door side of the rig floor, lies in right access area 213. In embodiments in which a pipe handling system occupies V-door area 113, the pipe handling system will also lie in right access area 213. Also as drawn, the mast may occupy left access area 214 when it is in the down position as shown at 115.

Still referring to FIG. 2, a second pair of phantom lines 310, 312 are each parallel to one side of rig floor 101 perpendicular to longitudinal axes of the support structures. Lines 310, 312 define a second access area 311 therebetween. By definition, rig floor 101 lies in second access area 311. The portion of access area 311 below (as drawn) the rig floor is referred to herein as near access area 313 and the portion of access area 311 above (as drawn) the rig floor is referred to herein as the far access area 314. The remaining quadrants are referred to herein as far left quadrant 415, far right quadrant 416, near right quadrant 417, and near left quadrant 418. In the embodiment shown, no equipment occupies either near access area 313 or far access area 314. Nonetheless, as can been seen, substructures 103 prevent ready access to BOP 177 from either near access area 313 or far access area 314.

While lines 210, 212, 310, and 312 are shown as substantially aligned with their respective edges of the rig floor, it will be understood that in some embodiments they could be farther apart or closer together. In some embodiments, lines 210 and 212 may be no farther apart than width of the space between the substructures 103. In some embodiments, lines 310 and 312 may be closer together, such that access area 311 is much narrower.

Similarly, while lines 210, 212, 310, and 312 are shown as extending substantially away from rig floor 101, access areas 213, 214, 313, and 314 can vary in size, depending on the extent to which they extend away from the rig floor. In some embodiments, access areas 213, 214, 313, and 314 are each substantially square, i.e. they extend away from the rig floor by a distance that is substantially equal to their respective widths, which may or may not correspond to the dimensions of the rig floor. In other embodiments, one or more of access areas 213, 214, 313, and 314 may be rectangular.

It has been found that management of the space around the rig floor, and in particular access areas 213, 214, 313, and 314, can contribute to the successful operation of the rig. In particular, it has been found beneficial to position as much as possible, and preferably all, of the backyard equipment outside of access areas 213, 214, 313, and 314. By way of example, it may be preferred to position as much as possible, and preferably all, of the backyard equipment in far left quadrant 415. In this embodiment, when the mast is erected, left access area 214 will be clear of equipment, thereby providing ready access to BOP 177 between substructures 103. In the course of operations, it may be necessary to transport equipment through one of the access areas, but in preferred embodiments, at least left access area 214 and preferably also right access area 213 are kept free of equipment that is not in transit.

Figure 3:
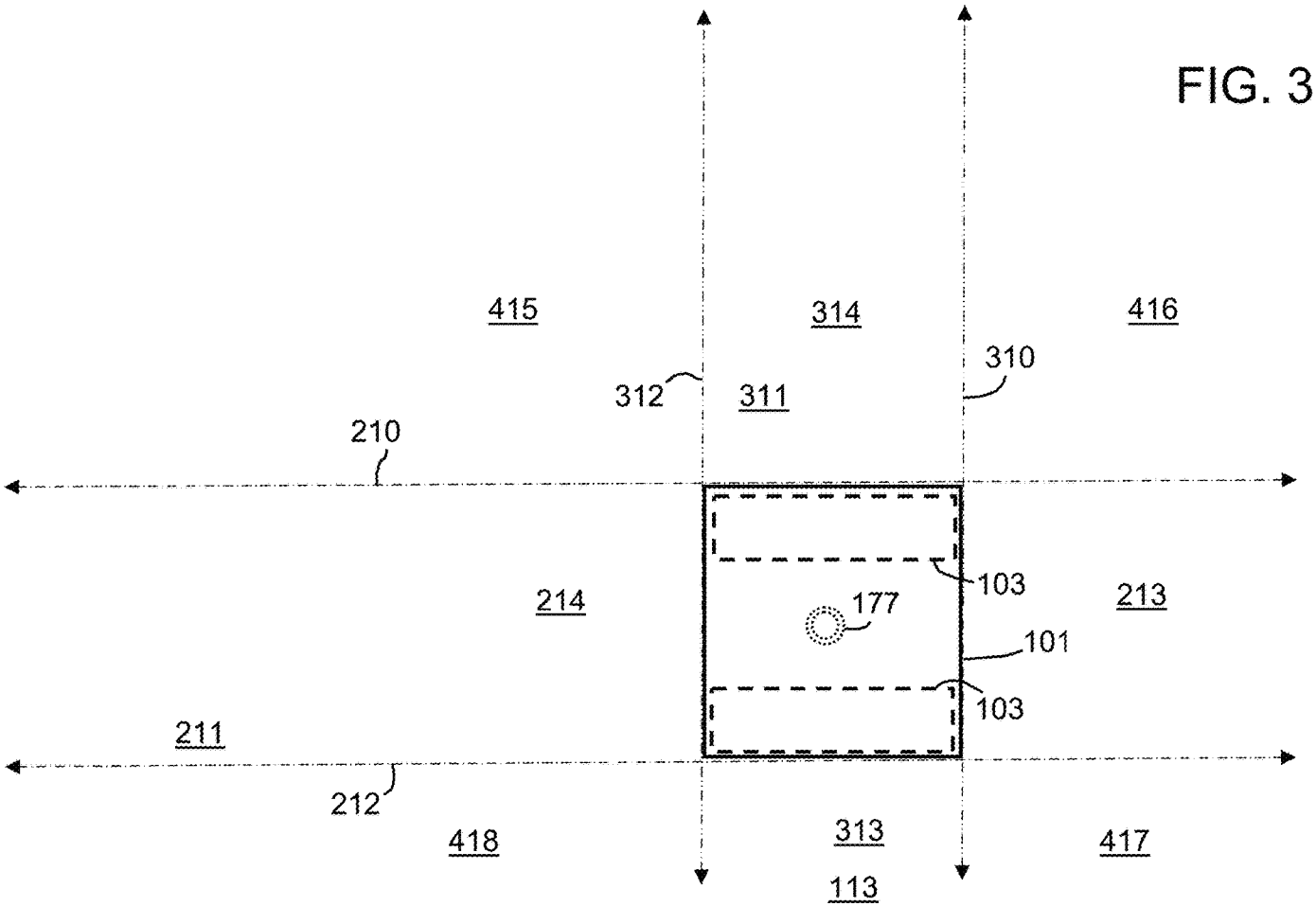
FIG. 3 is a schematic plan view of a wellsite in accordance with at least one embodiment of the present disclosure.
Figure 4:
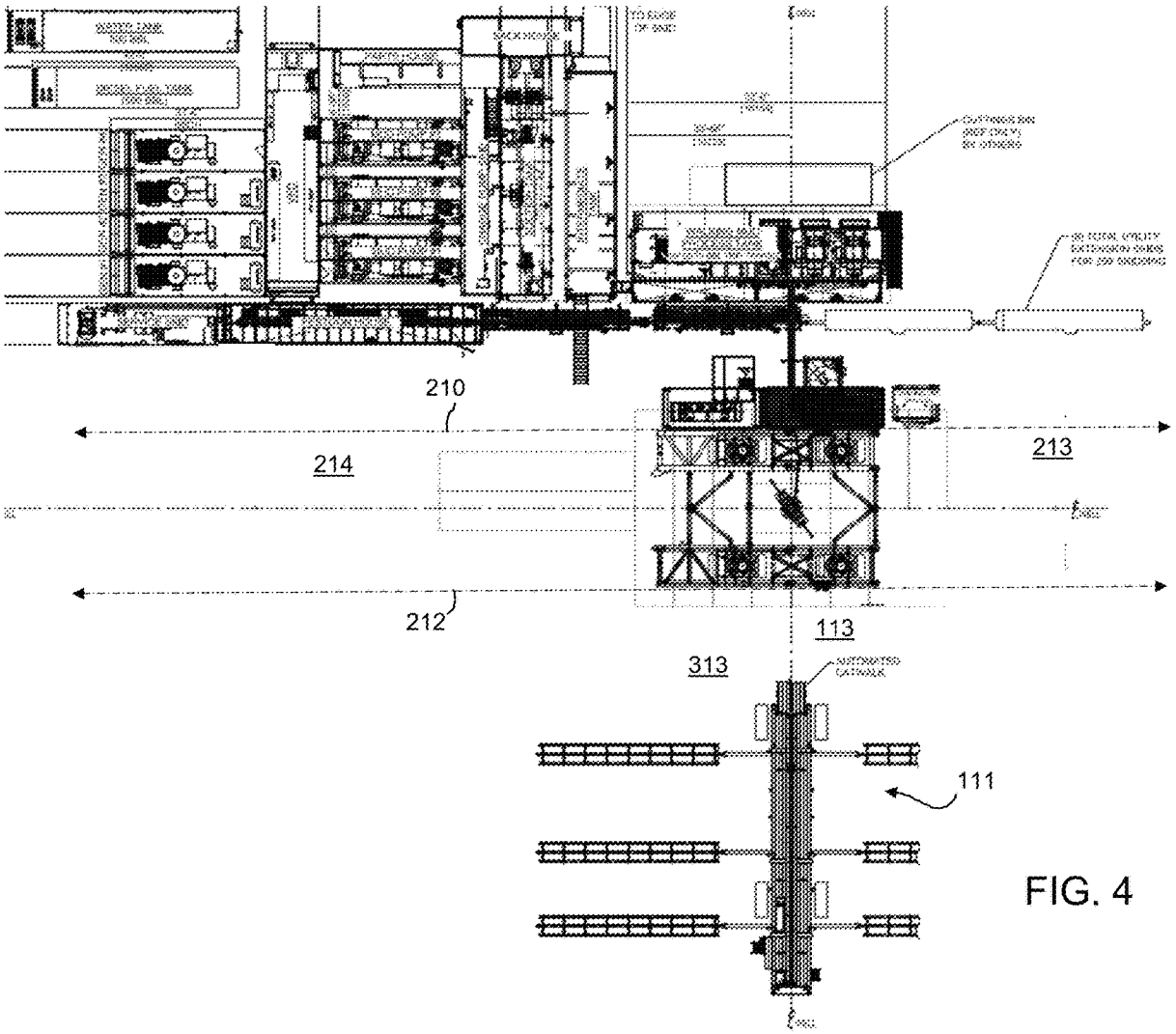
FIGS. 4, 5, and 6 are illustrations of exemplary wellsites in accordance with embodiments of the present disclosure.
Figure 5:
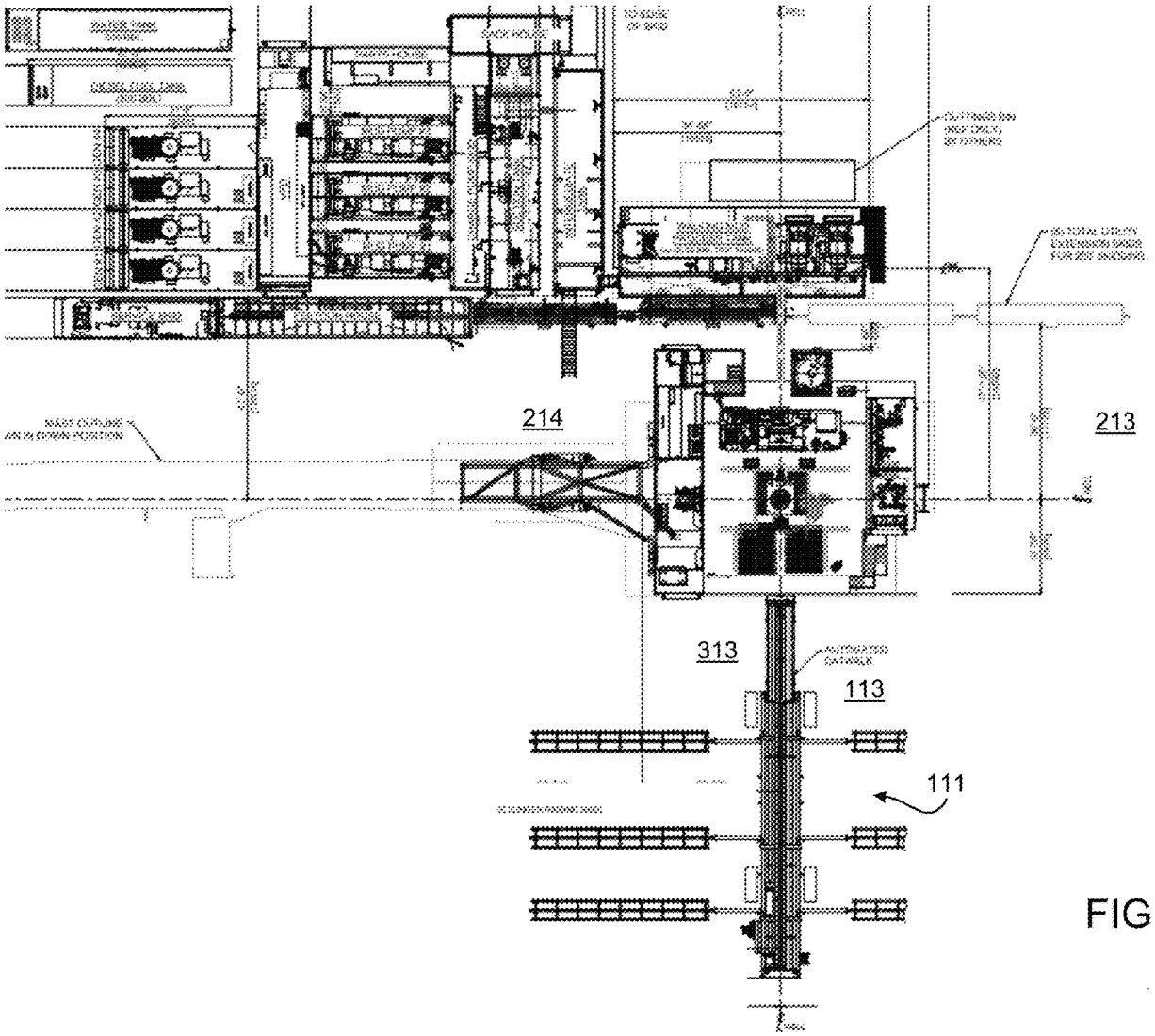
Figure 6:
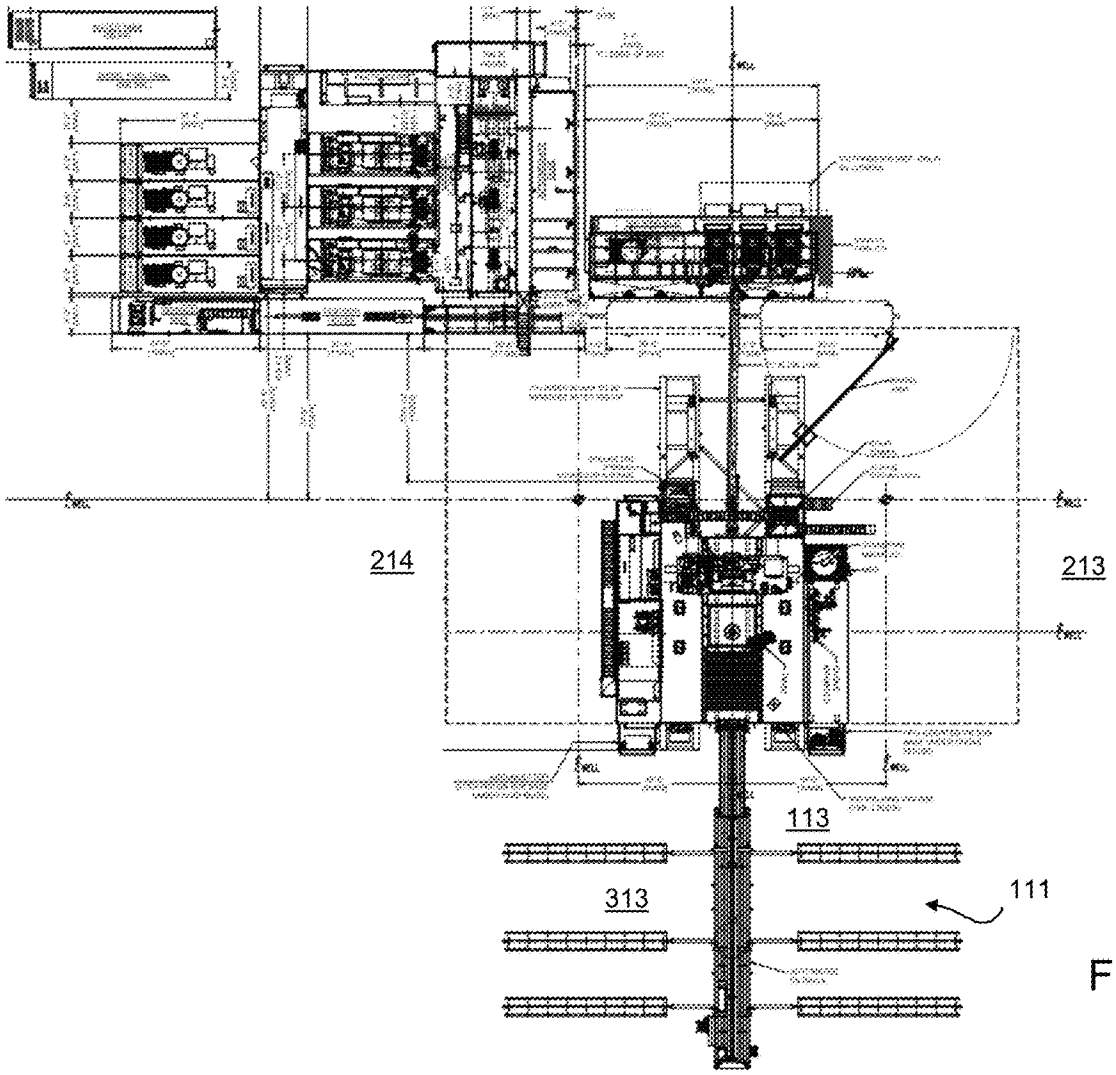

Referring now to FIG. 3, V-door area 113, has been moved from right access area 213 to near access area 313. In embodiments in which a pipe handling system occupies V-door area 113, the pipe handling system (not shown) would also lie in near access area 313. With V-door area 113 and the pipe handling system occupying near access area 313, the mast may either be similarly reoriented such that it occupies far access area 314 when in the down position, or the mast may remain as illustrated in FIG. 2, such that it occupies left access area 214 when in the down position. The latter configuration may be referred to as a side saddle configuration, as is disclosed in U.S. Pat. No. 9,810,027, which is incorporated herein by reference. In either case, when the mast is vertical, the embodiment shown in FIG. 3 provides clear access to BOP 177 from both right and left access areas 213, 214.

In the embodiments shown in FIGS. 2 and 3, the backyard equipment may occupy far left quadrant 415, or may be positioned in any of the other quadrants 416, 417, or 418. In some instances, all or a portion of the backyard equipment may also occupy far access area 314, as the layout of the structural supports 103 already precludes access to the BOP from far access area 314.

An advantage of the present disclosure is that it allows simultaneous rig-up of both the drilling rig and the backyard. Heretofore, it has been necessary to rig-up either the rig first, followed by the backyard, or the backyard first, followed by the rig. With the backyard equipment positioned out of the first access area, and preferably in the far left quadrant, the rig and backyard can be rigged-up simultaneously.

In some embodiments, one rig may be used to drill multiple wells in a single field. The process of moving the drilling rig from one well to another may be referred to as "walking" or "skidding." Systems known as festoon cable systems are often used to support, protect, and manage power or data cables and/or air or fluid hoses on rigs where auxiliary buildings and equipment are stationary and the drilling rig moves. Cabling, including communications and electrical power, may be extended along the path of travel by the festoon system. One type of festoon is a trolley system supported on fixed trolley beam sections supported on individual skids and connected together. In some embodiments, the cable handling apparatus may include a trolley beam, sliding cable trolley, and an articulating arm that is pivotably coupled to the trolley beam and to a piece of wellsite equipment. As disclosed in U.S. Pat. No. 9,353,601, which is incorporated herein by reference, the articulating arm may be repositionable between a retracted position and an extended position.

A festoon system such as an articulated festoon system or other festoon system may be used in conjunction with the present disclosure. For example, an articulated festoon system may be used when the backyard is positioned in the far left quadrant and it is desired to move, or "walk" or "skid," the rig from one drilling location (wellhead) to another.

Similarly, it may be desirable to maintain or facilitate connections between a walking rig and other rig equipment, including, for example, drilling fluid handling equipment. Such drilling fluid handling equipment may be referred to as mud handling equipment, and may include shaker tables, degassers, trip tanks, etc. In order to minimize losses in pumping the drilling fluid from the mud handling equipment, the distance between the mud handling equipment and the drilling rig, is typically kept as short as possible. Therefore, the mud handling equipment is typically located near the drilling rig and may need to be dragged or moved as the drilling rig is moved. Such an operation may require additional equipment such as a crane or pull truck, or may be performed by a walking mud handling system such as that disclosed in U.S. application Ser. No. 15/292,429, which is incorporated herein by reference. The walking mud handling system may include a walking mud tank and a plurality of hydraulic walkers coupled to the walking mud tank. The hydraulic walkers may include a walking foot, a hydraulic lift, and a sliding actuator. The hydraulic lift may include a hydraulic cylinder coupled to the walking foot such that extension of the hydraulic cylinder extends the walking foot into contact with the ground. The sliding actuator may include one or more hydraulic cylinders coupled to the walking foot such that extension of the sliding actuator moves the walking foot laterally relative to the hydraulic lift.

A walking or non-walking mud handling system, which may include a walking shaker tank, may be used in conjunction with the present disclosure. For example, a walking mud handling system may be used when the backyard is positioned in the far left quadrant and it is desired to move, or "walk" or "skid," the rig from one drilling location (wellhead) to another. Because it moves with the rig, the walking mud handling system is not considered backyard equipment.

In some embodiments, the backyard equipment may be positioned such that three sides of drilling rig 100 are not taken up by any generators 119, fuel tanks 121, variable frequency drives (VFDs) 123, mud pumps 125, parts houses 126, suction tanks 127, intermediate tanks 129, sack houses 131, charge pumps 135, service skids 137, water tanks 139, mud process tanks 141, cuttings bins 143, and trip tanks 145. The sides may be, as depicted in FIG. 2, right access area 213, left access area 214, and near access area 313. For example and without limitation, any generators 119, fuel tanks 121, variable frequency drives (VFDs) 123, mud pumps 125, parts houses 126, suction tanks 127, intermediate tanks 129, sack houses 131, charge pumps 135, service skids 137, water tanks 139, mud process tanks 141, cuttings bins 143, and trip tanks 145 may be positioned at a location laterally spaced apart from drilling rig 100 and preferably in at least one of the quadrants 415-418. In some embodiments, by positioning any of generators 119, fuel tanks 121, variable frequency drives (VFDs) 123, mud pumps 125, parts houses 126, suction tanks 127, intermediate tanks 129, sack houses 131, charge pumps 135, service skids 137, water tanks 139, mud process tanks 141, cuttings bins 143, and trip tanks 145 at the location laterally spaced apart from drilling rig 100, lowering of the mast into the down position may not require the movement or relocation of any generators 119, fuel tanks 121, variable frequency drives (VFDs) 123, mud pumps 125, parts houses 126, suction tanks 127, intermediate tanks 129, sack houses 131, charge pumps 135, service skids 137, water tanks 139, mud process tanks 141, cuttings bins 143, and trip tanks 145.

Similarly, by locating of any generators 119, fuel tanks 121, variable frequency drives (VFDs) 123, mud pumps 125, parts houses 126, suction tanks 127, intermediate tanks 129, sack houses 131, charge pumps 135, service skids 137, water tanks 139, mud process tanks 141, cuttings bins 143, and trip tanks 145 as described, drilling rig 100 may be moved (for example by skidding or walking) from wellhead 15 to a second wellhead (shown as denoted 15' in FIG. 1) without the need to relocate any of the above-referenced equipment.

It will be understood that, as the rig moves, or walks, from one location to another within wellsite 10, the areas defined relative to the substructures 103 will also move. In some embodiments, the non-moving equipment required for drilling is positioned within the wellsite such that one or more of the designated clear areas is clear for all expected positions and configurations of the rig.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

Likewise, the sequential recitation of steps in any claims below is not a requirement that the steps be performed sequentially and, unless an order is explicitly recited or inherently required, the steps may be performed in any order.

The invention claimed is:

1. A system comprising:

a wellsite, the wellsite including a wellbore location and a blowout preventer (BOP) positioned at the wellbore location;

a drilling rig positioned in the wellsite, the drilling rig including a rig floor and at least one substructure, the substructure having a longitudinal axis, the rig floor including a V-door side, the side of the drilling rig adjacent to the V-door side defining a V-door area, the drilling rig including a mast pivotably coupled to the drill floor and pivotable between raised and lowered positions;

a pipe handling system;

a first access area defined as the area between a pair of lines extending parallel to the longitudinal axis of the substructure such that the BOP is between the lines, the first access area being free of equipment that is not in transit, the first access area including a left access area on a first side of the rig and a right access area on an opposite side of the rig from the left access area, the left access area being free of equipment that is not in transit; and a second access area defined as the area between a pair of lines extending perpendicular to the longitudinal axis of the substructure, wherein the second access area includes a far access area on one side of the rig and a near access area on an opposite side of the rig from the far access area, wherein a far left quadrant is defined between the left access area and the far access area, further including at least one piece of backyard equipment in the far left quadrant;

wherein the mast is in the far access area when in the lowered position and wherein the pipe handling system is not positioned in the far access area.

2. The system according to claim 1 wherein all of the backyard equipment is positioned in the far left quadrant.

3. The system according to claim 2 wherein the backyard equipment comprises one or more of a generator, a fuel tank, a variable frequency drive (VFD), a mud pump, a parts house, a suction tank, an intermediate tank, a sack house, a charge pump, a service skid, a water tank, a mud process tank, a cuttings bin, and a trip tank.

4. The system of claim 1, wherein the pipe handling system is in the right access area.

5. The system of claim 1, wherein the pipe handling system is in the near access area.

6. The system according to claim 1, further including a walking mud handling system in fluid communication with the rig.

7. The system according to claim 1, further including a festoon system supporting cables that are connected to equipment on the rig.

8. The system of claim 1 wherein the drilling rig comprises two substructures, each substructure being generally rectangular in footprint and spaced apart in a parallel fashion.

9. The system of claim 8 wherein the V-door side is parallel to the longitudinal axes of the substructures, further including a catwalk having a longitudinal axis that is perpendicular to the longitudinal axes of the substructures.

10. The system of claim 8 wherein the V-door side is perpendicular to the longitudinal axes of the substructures, further including a catwalk having a longitudinal axis that is parallel to the longitudinal axes of the substructures.

11. A method of drilling multiple wells on a single wellsite, comprising the steps of:

a) providing a first wellbore location;

b) positioning a blowout preventer (BOP) at the wellbore location;

c) positioning a drilling rig at the wellbore location, the drilling rig including a rig floor and at least one substructure, the substructure having a longitudinal axis, the rig floor including a V-door side, the side of the drilling rig adjacent to the V-door side defining a V-door area, the drilling rig including a mast pivotably coupled to the drill floor and pivotable between raised and lowered positions;

d) defining a first access area as the area between a pair of lines extending parallel to the longitudinal axis of the substructure such the BOP is between the lines, the first access area including a left access area on a first side of the rig and a right access area on an opposite side of the rig from the left access area, the left access area being free of equipment that is not in transit;

e) defining a second access area as the area between a pair of lines extending perpendicular to the longitudinal axis of the substructure, wherein the second access area includes a far access area on one side of the rig and a near access area on an opposite side of the rig from the far access area, wherein a far left quadrant is defined between the left access area and the far access area, further including at least one piece of backyard equipment in the far left quadrant, the mast is positioned in the far access area when in the lowered position;

f) positioning a pipe handling system in the left, right, or near access area;

g) using the rig to drill at the first wellbore location; and h) maintaining the first access area free of equipment that is not in transit at least during drilling.

12. The method of claim 11 wherein the V-door area is not in the first access area.

13. The method of claim 11, further including accessing the BOP from a side of the rig adjacent to the V-door side.

14. The method of claim 11, further including, before step e), the steps of:

i) providing at least one piece of backyard equipment; and ii) simultaneously rigging-up the backyard equipment and the drilling rig.

15. The method of claim 14, further including maintaining the first access area free of equipment that is not in transit during step ii).

* * * * *